United States Patent [19]

Hayafuchi et al.

[11] Patent Number: 4,858,339

[45] Date of Patent: Aug. 22, 1989

[54] COMPOSITE RUBBER SHEET MATERIAL AND SPORTS SHOE EMPLOYING THE SAME

[75] Inventors: Hideki Hayafuchi, Kurume; Yoshiharu Moronaga, Saga; Kiyotaka Nakano, Kurume, all of Japan

[73] Assignee: Nippon Rubber Co., Ltd., Tokyo, Japan

[21] Appl. No.: 141,524

[22] Filed: Jan. 7, 1988

[30] Foreign Application Priority Data

Jan. 10, 1987 [JP] Japan ..... 57-2061[U]
Feb. 24, 1987 [JP] Japan ..... 57-27067[U]

[51] Int. Cl.[4] ..... A43B 23/60; A43B 5/00; A43B 23/16

[52] U.S. Cl. ..... 36/45; 36/68; 36/114; 36/129

[58] Field of Search ..... 36/45, 46, 47, 68, 69, 36/114, 129, 92

[56] References Cited

U.S. PATENT DOCUMENTS

| | | | |
|---|---|---|---|
| 2,942,359 | 6/1960 | Bushway et al. . | |
| 3,555,706 | 1/1971 | Edmonds | 36/114 |
| 3,583,081 | 6/1971 | Hayashi | 36/45 |
| 3,793,750 | 2/1974 | Bowerman | 36/129 X |
| 3,822,488 | 7/1974 | Johnson | 36/129 |
| 3,851,411 | 12/1974 | Crosbie et al. | 36/68 |
| 4,255,876 | 3/1981 | Johnson | 36/45 X |
| 4,255,877 | 3/1981 | Bowerman | 36/129 |
| 4,430,811 | 2/1984 | Okada | 36/45 |
| 4,785,558 | 11/1988 | Shiomura | 36/45 X |

FOREIGN PATENT DOCUMENTS

| | | | |
|---|---|---|---|
| 1485624 | 10/1971 | Fed. Rep. of Germany | 36/129 |

OTHER PUBLICATIONS

*Raschez Lace Manufacture,* by B. Wheatley, Copyright 1972, Published by the National Knitted Outerwear Assoc., pp. 60, 61, 104, 105, and 106.

*Primary Examiner*—James K. Chi
*Attorney, Agent, or Firm*—Birch, Stewart, Kolasch & Birch

[57] ABSTRACT

A composite rubber sheet material and a sport shoe including a composite rubber sheet material includes a sponge rubber sheet and a mesh cloth having a percentage of voids in the range of 15 to 75%. The mesh cloth is inset in one side surface of the sponge rubber sheet to a depth ranging from 5 to 75% of the thickness of the mesh cloth for enhancing the stability, durability, bendability and flexibility of the composite rubber sheet material.

29 Claims, 3 Drawing Sheets

COMPOSITE RUBBER SHEET MATERIAL AND SPORTS SHOE EMPLOYING THE SAME

BACKGROUND OF THE INVENTION

1. Field of the Invention

The present invention relates to a rubber sheet and more specifically a composite rubber sheet material which may be used as a shoe material, a protective sports material, a rubber material for bellows, a floor sheet material or the like and to a sports shoe using the same.

2. Description of Background Art

Hithertofore a material has been known wherein a cloth is adhered to one side surface of a sponge rubber sheet. In another known material, a woven cloth or mesh cloth is inset in a sponge rubber sheet as a core material. In the former, however, the one side surface of the sponge rubber sheet is restrained by the cloth over the entire surface. When the sheet is bent, a large difference is created between the tension modulus and the creep characteristics of the cloth and the sponge rubber sheet. Thus, a large shearing force is applied to the interface to result in a disadvantage in that an interfacial separation of the cloth from the sponge rubber takes place at the bent portion or the sponge rubber is damaged due to fatigue. Therefore, a poor durability results. In the latter, the disadvantage is that the expansion and contraction characteristic of the woven cloth or the mesh cloth is lost and bendability of the sheet material thus hampered since the woven cloth or mesh cloth is wholly inset or buried in the sponge rubber sheet.

SUMMARY AND OBJECTS OF THE INVENTION

This invention is intended to provide a rubber sheet material which is free from the foregoing defects, more specifically a durable rubber sheet material which has an adequate flexibility and which is excellent in after-bend resilience recovery and in shock absorption.

In order to carry out the foregoing object, the present invention provides a composite rubber sheet material which is characterized in that a mesh cloth includes a percentage of voids ranging from 15 to 75% is stuck to one side surface of a sponge rubber sheet in such a manner that the mesh cloth is inset in the sponge rubber sheet to a depth amounting to 5 to 75% of the thickness of the mesh cloth.

The percentage of voids herein refers to a ratio in terms of percentage of surface area of voids formed by through-holes or meshes of the mesh cloth to the total surface area of the mesh cloth.

In the present invention, the percentage of voids is specifically limited to a 15 to 75% range because, if the percentage of voids is lower than this range, the area of the mesh cloth restraining the sponge rubber sheet becomes too large and results in too large a difference between the tension modulus and the creep characteristic of the mesh cloth and the sponge rubber sheet when the composite rubber sheet material is bent as observed in a conventional material of this kind. As a result, a large shearing force is applied to the interface thereof to cause the mesh cloth and the sponge rubber sheet to be separated from each other along the bent portion thereof. In addition, the sponge rubber sheet may be damaged by fatigue for a resultant lesser durability. If the percentage of voids is higher than this range, the area of the mesh cloth restraining the sponge rubber sheet becomes too small. Although flexibility of the rubber sheet is better, the tension modulus becomes smaller and further the creep characteristic becomes greater. All of the above combine to lessen the after-bend resilience recovery power and the durability of the composite rubber sheet material.

The reason why the mesh cloth is stuck to the sponge rubber sheet in such a manner that its inset depth in the sponge rubber sheet may be in the range of 5 to 75% of its own thickness is because, outside of this range, disadvantages may result. If the depth is less than this range, the sponge rubber sheet as a whole cannot absorb through the mesh cloth the tensile pressure and the shrinkage or impact pressure generated when bent. Thus, a lower durability results with lower impact absorption power. If the depth is more than this range, the expansion and contraction characteristic of the mesh cloth becomes degraded to result in a lower bendability of the rubber sheet material.

Formed as described in the foregoing, a composite rubber sheet material of the present invention provides advantages in that, when the material is being bent, an adequate bendability thereof is assured by the exposed portion of the mesh cloth. In addition, when bent, bendability of the rubber sheet is adequately restrained by the large tension modulus and the small creep characteristic of the mesh cloth resulting from the specified partial insetting or burial of said mesh cloth in said sponge rubber sheet. Thus, the present invention results in good after-bend resilience recovery. Further, good durability and good impact absorption power are obtained since expansion pressure, shrinkage pressure and impact pressure generated when bent are effectively dispersed over all of the sponge rubber sheet through the mesh cloth and then absorbed thereby.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

An embodiment of the present invention will now be explained with reference to the drawings as follows.

Figure 1:
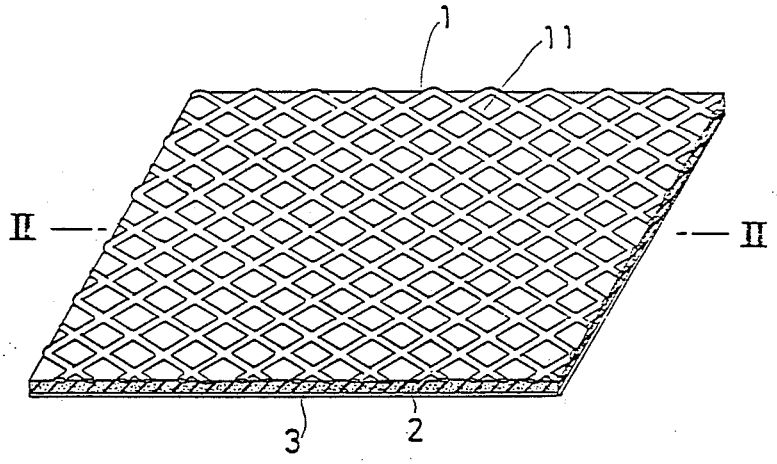
FIG. 1 is a perspective view of an embodiment example of a rubber sheet material according to the present invention.
Figure 2:
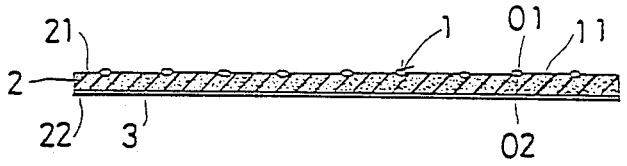
FIG. 2 is a sectional end view taken along the line II—II in FIG. 1.
Figure 3:
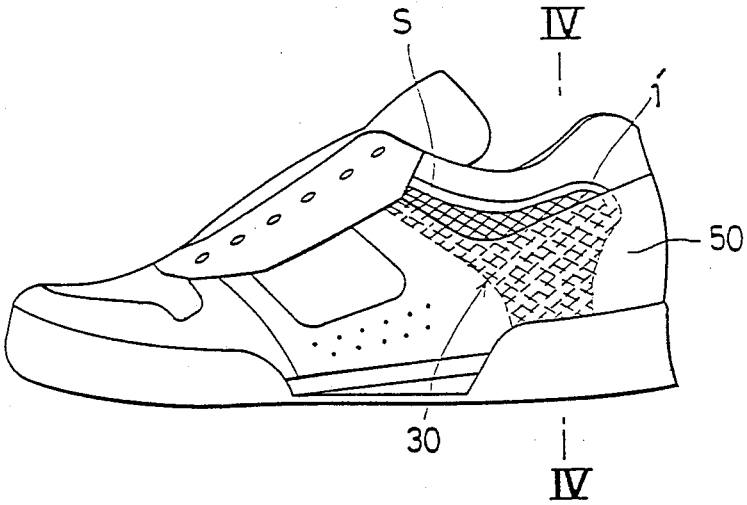
FIG. 3 is a side view of an embodiment example of this invention in which a rubber sheet material of this invention is used in a sports shoe.
Figure 4:
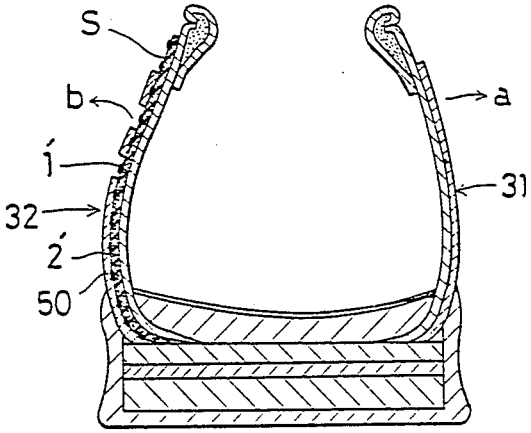
FIG. 4 is a sectional end view taken along the line IV—IV in FIG. 3.

FIGS. 1 and 2 illustrate an example of a composite rubber sheet material according to the present invention. A mesh cloth 1 includes a percentage of voids in the range of 15 to 75%. A sponge rubber sheet 2 is provided adjacent to the mesh cloth 1 and is adhered to one side surface of the sponge rubber sheet 2 in such a way that it may be inset in the sponge rubber sheet 2 to have 5 to 75% of its thickness buried in the sponge rubber sheet. Also referring to FIG. 2, an exposed portion 01 of the mesh cloth 1 and an inset or buried portion 02 thereof are illustrated.

The mesh cloth 1 can be a knitted mesh fabric such as tulle, marquisette or the like or one of various knitted lace materials, made of natural or synthetic fibers. Voids 11, 11 can be formed of through-holes or meshes having a circular shape or a polygonal shape such as a triangular, rectangular, pentagonal or hexagonal shape or the like and are distributed throughout the mesh cloth 1. Different shapes and patterns of the voids 11, 11 in the mesh cloth can be selected according to the purpose of use thereof. Thus, various patterns may be formed on the surface of the rubber sheet 2. The sponge rubber sheet 2 is made from one or more of various kinds of natural or synthetic rubber.

The mesh cloth 1 may be adhered to one side surface 21 of the sponge rubber sheet 2 by being partially inset therein. However, it is more desirable to have the mesh cloth 1 inset in the sponge rubber sheet 2 in such a manner that they are bonded to each other by, for example, a bonding agent of the isocyanates series. If necessary, another mesh cloth or similar flexible thin cloth 3 may be adhered to the other side surface 22 of the sponge rubber sheet.

The composite rubber sheet material of the present invention is specially suitable for use as a sports shoe material. Thus, the material may be used to provide a sports shoe fully meeting such requirements as heel stability, comfortable wear and effective shock absorption power.

Figure 5:
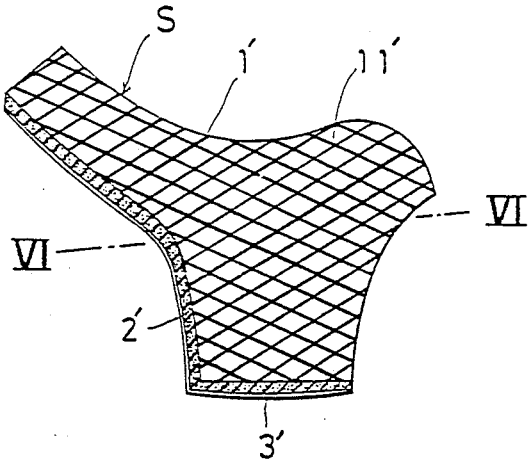
FIG. 5 is a perspective view of the rubber sheet material used in the sports shoe.
Figure 6:
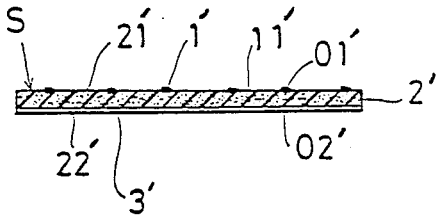
FIG. 6 is a sectional end view taken along the line VI—VI in FIG. 5.

An example of the sports shoe according to the present invention is now explained with reference to FIGS. 3 to 6, wherein a mesh cloth 1' includes a percentage of voids in the range of 15 to 75% is adhered to one side surface 21' of a sponge rubber sheet 2' having a hardness in the range of 40 to 75 according to the SRIS-0101 standards established by the Japan Rubber Association with respect to physical testing methods for expanded rubber. The mesh cloth 1' may be inset or buried in one side surface 21' of the rubber 2' as deeply as 5 to 75% of the thickness of the cloth to produce the composite rubber sheet material S. Thereafter, the composite rubber sheet material S is attached so as to overlap a heel portion 30 of the uppers of the shoe in such a manner that its surface with the mesh cloth adhered thereto may face outwards. Voids 11' are illustrated in FIGS. 5 and 6.

In the example of an embodiment according to the present invention, the hardness of the sponge rubber sheet is specified as 40° to 75° rated according to the SRIS-0101 standards. If the range is lower, the resultant composite rubber sheet material will be too soft to be over-bendable, thus causing a defect such as poor heel stability. If the range is higher, the material will become too hard to result in insufficient flexibility thereof, so that the shoe will be less comfortable to wear.

As occasion demands, another mesh cloth or other flexible thin cloth 3' may be adhered to the other side surface 22' of the sponge rubber sheet 2'.

The composite rubber sheet material S formed as described in the foregoing is thus placed so as to overlap a heel portion 30 of the uppers of the shoe in such a manner that its surface with the mesh cloth may face outwards. In the case of a shoe like one for an ordinary running use of which the heel portion tends to excessively lean transversely inwards during running and which is thus likely to sprain the wearer's ankle inwards, the composite rubber sheet material may be overlaid only on the inner side above heel portion 31 of the uppers of the shoe.

If the shoe is for playing tennis or the like in which the heel portion tends to excessively lean transversely outwards as turns and stops and runs have to be made quickly, and thus it is likely to sprain the ankle outwards during play, the rubber sheet material may be overlaid only on the outer side heel portion 32 of the uppers of the shoe.

If it is a basketball shoe or the like which is subjected to quick turns, stops and runs and turnabouts during the play and consequently tends to have its heel portions excessively lean transversely inwards and outwards, and is therefore likely to sprain the ankle both inwards and outwards alike during play, the rubber sheet material may be overlaid on both the inner and outer side heel portions 31, 32 of the uppers. In short, the heel portions 30 of the uppers where the rubber sheet material S is to be overlaid or attached are properly determined by taking into consideration the shoe's purpose of use.

If necessary, the rubber sheet material S may be further coated with a heel portion reinforcement 50 such as one made of leatherette.

Formed as described in the foregoing, the rubber sheet material S attached so as to overlap the heel portion 30 of the uppers acts as follows when the portion 30 is about to lean excessively in the inward direction a or outward direction b during exercise.

More specifically, when the rubber sheet material S is being bent in the outward direction, its bendability in the outward direction is adequately maintained by the exposed portion 01' of the mesh cloth 1' while the bendability is adequately restrained by the large tension modulus and the lower creep characteristic of the inset or buried portion 02' of the mesh cloth. Thus, strengthening of the after bend resilience recovery power of the sponge rubber sheet 2' is possible so that the heel portion 30 of the uppers can be quickly returned to its normal position due to the composite rubber sheet material S attached thereto.

Therefore, an excessive transverse leaning of the heel portion of the uppers of the shoe possible during exercise can be prevented to provide a better fitting stability.

Further, the bending and impact pressures applied to the rubber sheet material S are dispersed over the sponge rubber sheet 2' through the mesh cloth 1' and thus absorbed effectively by the sponge rubber sheet 2' so that better durability and shock absorption can be obtained.

Another advantage is that the present invention provides a shoe which gives the feel of a good fit and is comfortable to wear because the inner side of the rubber sheet material 1 which is attached to the shoe is formed from the sponge rubber sheet 2'.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A composite rubber sheet material comprising:
a sponge rubber sheet; and
a mesh cloth having a percentage of voids in the range of 15 to 75%;
said mesh cloth being inset in one side surface of the sponge rubber sheet to a depth ranging from 5 to 75% of the thickness of the mesh cloth to limit the tension modulus and creep characteristics of the mesh cloth and the sponge rubber sheet and for absorbing tensile pressure and impact pressure for enhancing the stability, durability, bendability and flexibility of the composite rubber sheet material.

2. A composite rubber sheet material according to claim 1, wherein said mesh cloth is a knitted mesh fabric such as tulle made of natural fibers.

3. A composite rubber sheet material according to claim 1, wherein said mesh cloth is a knitted mesh fabric such as tulle made of synthetic fibers.

4. A composite rubber sheet material according to claim 1, wherein said mesh cloth is a knitted mesh fabric such as marquisette made of natural fibers.

5. A composite rubber sheet material according to claim 1, wherein said mesh cloth is a knitted mesh fabric such as marquisette made of synthetic fibers.

6. A composite rubber sheet material according to claim 1, wherein said mesh cloth is a knitted mesh fabric such as knitted lace made of natural fibers.

7. A composite rubber sheet material according to claim 1, wherein said mesh cloth is a knitted mesh fabric such as knitted lace made of synthetic fibers.

8. A composite rubber sheet material according to claim 1, wherein said voids of said mesh cloth are formed of through holes or meshes having a circular, polygonal, triangular, rectangular, pentagonal or hexagonal shape.

9. A composite rubber sheet material according to claim 1, wherein said mesh cloth is inset in and bonded to said sponge rubber sheet.

10. A composite rubber sheet material according to claim 1, wherein said sponge rubber sheet is made of natural rubber.

11. A composite rubber sheet material according to claim 1, wherein said sponge rubber sheet is made of synthetic rubber material.

12. A composite rubber sheet material according to claim 1, wherein said sponge rubber sheet has a hardness of 40° to 75° according to SRIS-0101 standards.

13. A composite rubber sheet material according to claim 1, wherein another mesh cloth is adhered to the reverse side surface of the sponge rubber sheet.

14. A sport shoe having an upper portion and a sole portion wherein a composite rubber sheet material overlapping a heel portion of said upper portion comprises:
a sponge rubber sheet having a hardness of 40 to 75 according to the SRIS-0101 standards; and
a mesh cloth having a percentage of voids ranging from 15 to 75%;
said mesh cloth being inset in said rubber sheet to a depth ranging from 5 to 75% of the thickness of the cloth to limit the tension modulus and creep characteristics of the mesh cloth and the sponge rubber sheet and for absorbing tensile pressure and impact pressure for enhancing the stability, durability, bendability and flexibility of the composite rubber sheet material.

15. A sport shoe according to claim 14, wherein said mesh cloth is a knitted mesh fabric such as tulle made of natural fibers.

16. A sport shoe according to claim 14, wherein said mesh cloth is a knitted mesh fabric such as tulle made of synthetic fibers.

17. A sport shoe according to claim 14, wherein said mesh cloth is a knitted mesh fabric such as marquisette made of natural fibers.

18. A sport shoe according to claim 14, wherein said mesh cloth is a knitted mesh fabric such as marquisette made of synthetic fibers.

19. A sport shoe according to claim 14, wherein said mesh cloth is a knitted mesh fabric such as knitted lace made of natural fibers.

20. A sport shoe according to claim 14, wherein said mesh cloth is a knitted mesh fabric such as knitted lace made of synthetic fibers.

21. A sport shoe according to claim 14, wherein said voids of said mesh cloth are formed of through holes or meshes having a circular, polygonal, triangular, rectangular, pentagonal or hexagonal shape.

22. A sport shoe according to claim 14, wherein said mesh cloth is inset in and bonded to said sponge rubber sheet.

23. A sport shoe according to claim 14, wherein said sponge rubber sheet is made of natural rubber.

24. A sport shoe according to claim 14, wherein said sponge rubber sheet is made of synthetic rubber material.

25. A sport shoe according to claim 14, wherein another mesh cloth is adhered to the reverse side surface of the sponge rubber sheet.

26. A sport shoe according to claim 14, wherein said rubber sheet material is further coated on an outer side surface with a heel reinforcement.

27. A sport shoe according to claim 14, wherein said rubber sheet material is attached to overlap an inner side heel portion of the uppers of said shoe.

28. A sport shoe according to claim 14, wherein said rubber sheet material is attached to overlap an outer side heel portion of the uppers of said shoe.

29. A sport shoe according to claim 14, wherein said rubber sheet material is attached to overlap both an inner and outer side heel portion of the uppers of said shoe.

* * * * *